US009890746B2

(12) United States Patent
Dudar

(10) Patent No.: US 9,890,746 B2
(45) Date of Patent: Feb. 13, 2018

(54) CONCENTRIC CONICAL FUEL VAPOR CANISTER

(71) Applicant: Ford Global Technologies, LLC, Dearborn, MI (US)

(72) Inventor: Aed M. Dudar, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 246 days.

(21) Appl. No.: 14/552,317

(22) Filed: Nov. 24, 2014

(65) Prior Publication Data

US 2016/0146157 A1 May 26, 2016

(51) Int. Cl.
*F02M 25/08* (2006.01)

(52) U.S. Cl.
CPC ..... *F02M 25/089* (2013.01); *F02M 25/0854* (2013.01); *F02M 25/0836* (2013.01)

(58) Field of Classification Search
CPC ..... F02M 25/089; F02M 25/0854; F02M 25/0836
USPC ..... 123/519
See application file for complete search history.

(56) References Cited

U.S. PATENT DOCUMENTS 4,013,054 A * 3/1977 Balsley ..... F02D 41/0042 123/519
4,338,106 A * 7/1982 Mizuno ..... F02M 25/0854 123/519
4,448,594 A * 5/1984 Kozawa ..... H01L 21/22 123/519
4,454,849 A * 6/1984 Mizuno ..... F02M 25/0854 123/519
4,717,401 A 1/1988 Lupoli et al.
4,750,923 A 6/1988 Haruta et al.
4,951,643 A * 8/1990 Sato ..... F02M 25/0836 123/519
5,269,837 A 12/1993 Ohashi et al.
5,479,907 A * 1/1996 Walker, Jr. ..... F01M 13/023 123/198 E
5,840,104 A 11/1998 Hashimoto et al.
5,934,069 A * 8/1999 Hertl ..... F01N 3/0835 60/274
6,258,144 B1 * 7/2001 Huang ..... B01D 46/0049 123/593
7,278,406 B2 10/2007 Hagler
7,900,607 B2 * 3/2011 Lang ..... B01D 53/0407 123/518
8,015,965 B2 9/2011 Yamasaki
(Continued)

FOREIGN PATENT DOCUMENTS

KR 100882644 B1 2/2009

*Primary Examiner* — David Hamaoui
(74) *Attorney, Agent, or Firm* — James Dottavio; McCoy Russell LLP

(57) ABSTRACT

A fuel vapor canister is presented, comprising two or more pneumatically coupled concentric adsorbent beds, a vent port configured to deliver fresh air to an outermost concentric adsorbent bed, and a purge port configured to couple an engine intake to an innermost concentric adsorbent bed. The concentric adsorbent beds facilitate improved purging of the canister, thus decreasing bleed emissions. The concentric adsorbent beds may have a bi-conical structure yielding a conical flow path which allows fresh air to flow through the adsorbent beds equally, reducing the size of a canister heel.

19 Claims, 5 Drawing Sheets

(56) References Cited

U.S. PATENT DOCUMENTS

| | | | | |
|---|---|---|---|---|
| 8,439,013 | B2 | 5/2013 | Bellis | |
| 8,617,299 | B2 * | 12/2013 | Hasegawa | B01D 53/02 123/519 |
| 2011/0168025 | A1 | 7/2011 | Huynh | |
| 2013/0253799 | A1 * | 9/2013 | Peters | F02M 25/0818 701/102 |

* cited by examiner

CONCENTRIC CONICAL FUEL VAPOR CANISTER

BACKGROUND AND SUMMARY

Vehicle emission control systems may be configured to store fuel vapors from fuel tank refueling and diurnal engine operations in a fuel vapor canister, and then purge the stored vapors during a subsequent engine operation. The stored vapors may be routed to engine intake for combustion, further improving fuel economy.

In a typical canister purge operation, a canister purge valve coupled between the engine intake and the fuel canister is opened, allowing for intake manifold vacuum to be applied to the fuel canister. Simultaneously, a canister vent valve coupled between the fuel canister and atmosphere is opened, allowing for fresh air to enter the canister. This configuration facilitates desorption of stored fuel vapors from the adsorbent material in the canister, regenerating the adsorbent material for further fuel vapor adsorption.

However, fresh air flow within and through the canister is not uniform. Regions of adsorbent that see relatively less air flow will retain relatively more adsorbed hydrocarbons. Typically, 10-15% of the canister will retain some quantity of hydrocarbons following a purge operation, and this amount may increase as the canister ages. The residual hydrocarbons may desorb over a diurnal cycle, leading to an increase in bleed emissions. Strategies to limit these bleed emissions have included secondary canisters and heating elements, both of which increase manufacturing costs and require additional diagnostic testing.

In one example, a fuel vapor canister is presented, comprising two or more pneumatically coupled concentric adsorbent beds, a vent port configured to deliver fresh air to an outermost concentric adsorbent bed, and a purge port configured to couple an engine intake to an innermost concentric adsorbent bed. The concentric adsorbent beds facilitate improved purging of the canister, thus decreasing bleed emissions. The fuel vapor canister may further comprise a load port configured to couple a fuel tank to the innermost concentric adsorbent bed. By loading the innermost concentric adsorbent bed, the innermost bed acts as a buffer for the canister. Thus, if the fuel tank is vented during purge events, the fuel vapor will not enter the engine intake directly, thus decreasing the likelihood of engine stalling. The concentric adsorbent beds may have a bi-conical structure. The bi-conical structure yields a conical flow path allows fresh air to flow through the adsorbent beds equally, reducing the size of a canister heel.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTIONS OF THE DRAWINGS

FIG. 1 schematically shows an example vehicle system with a fuel system and an evaporative emissions system.

DETAILED DESCRIPTION

Figure 1:
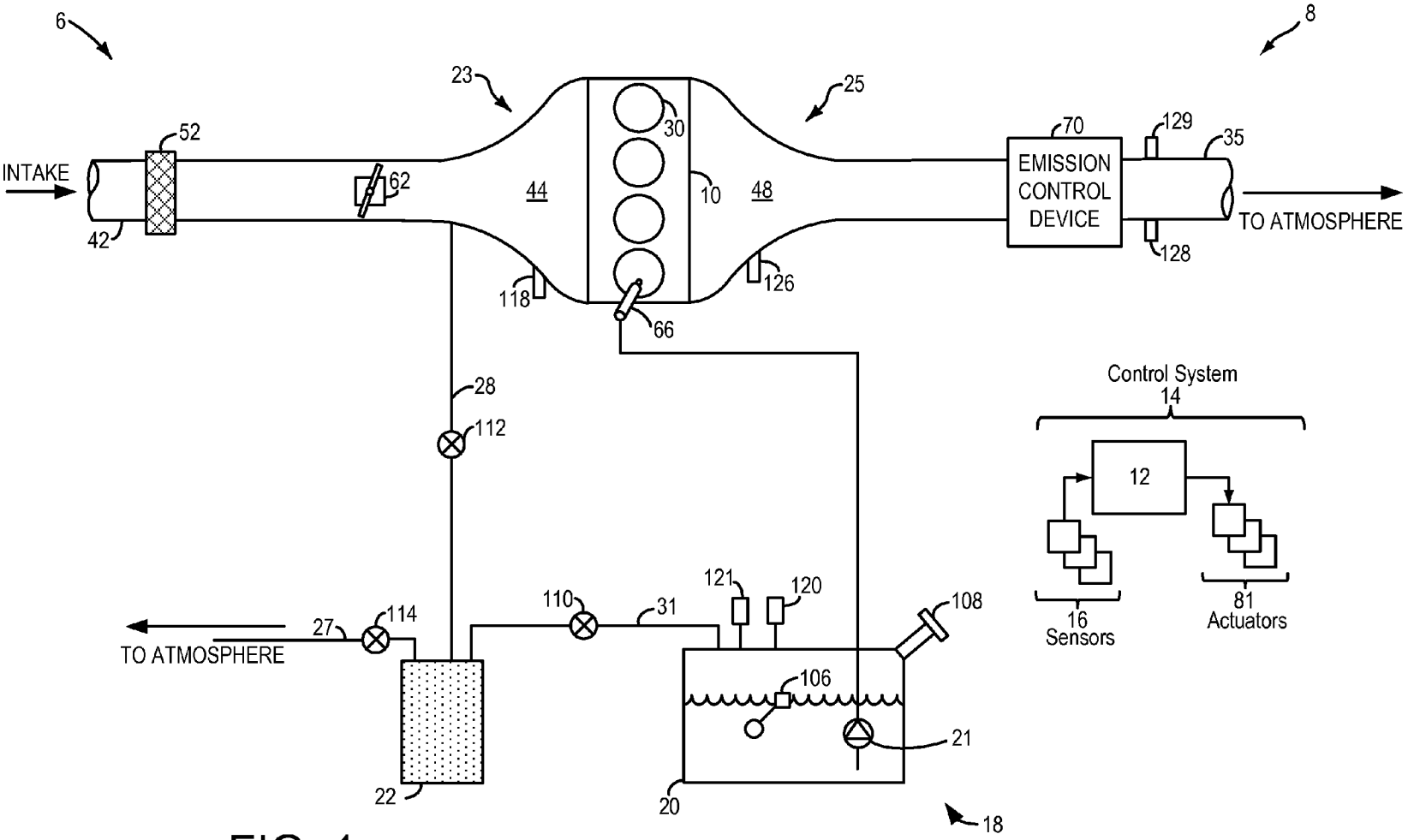
Figure 2:
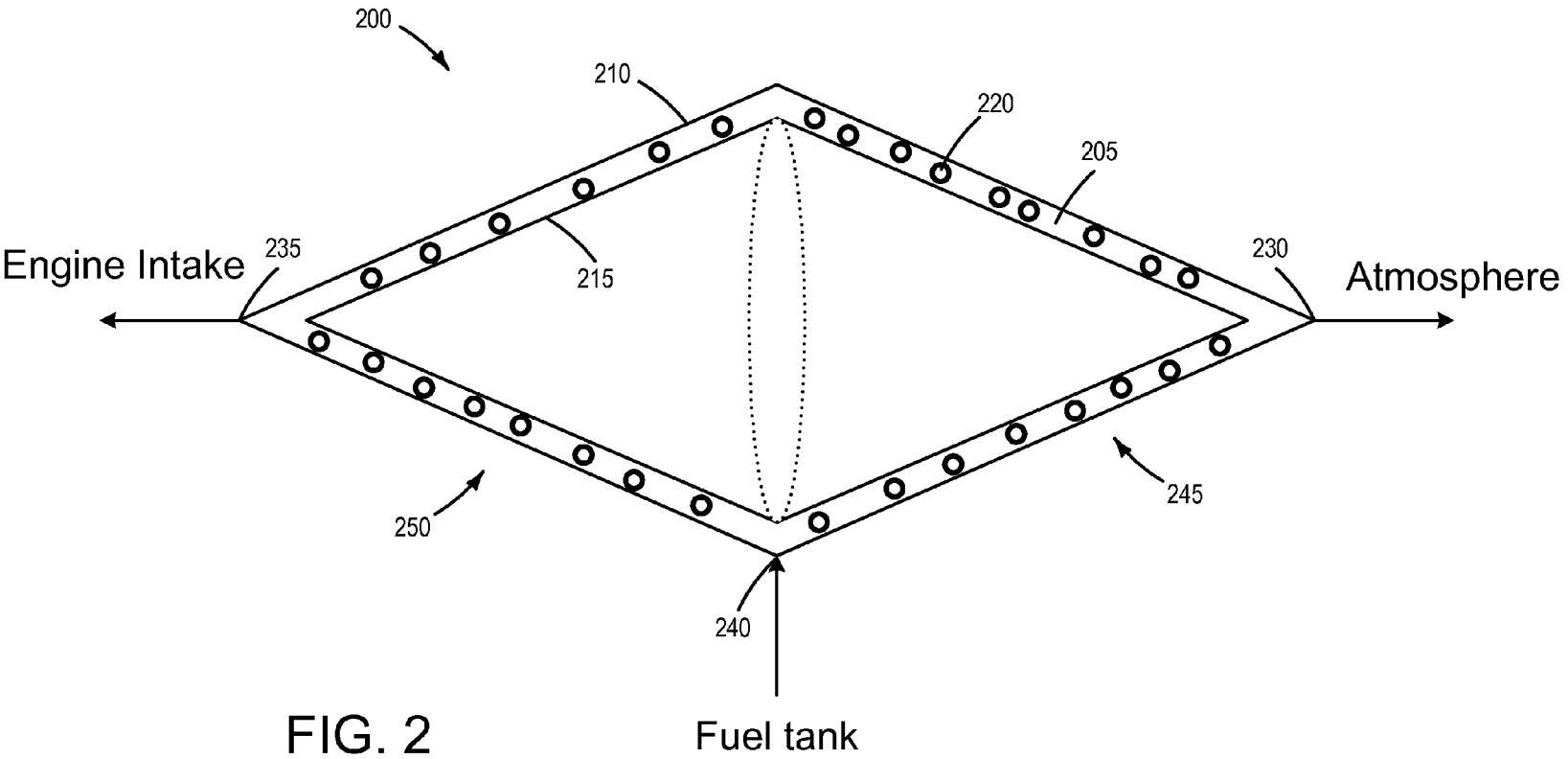
FIGS. 2-3 show example embodiments of a fuel vapor canister coupled in the fuel system of FIG. 1.
Figure 3:
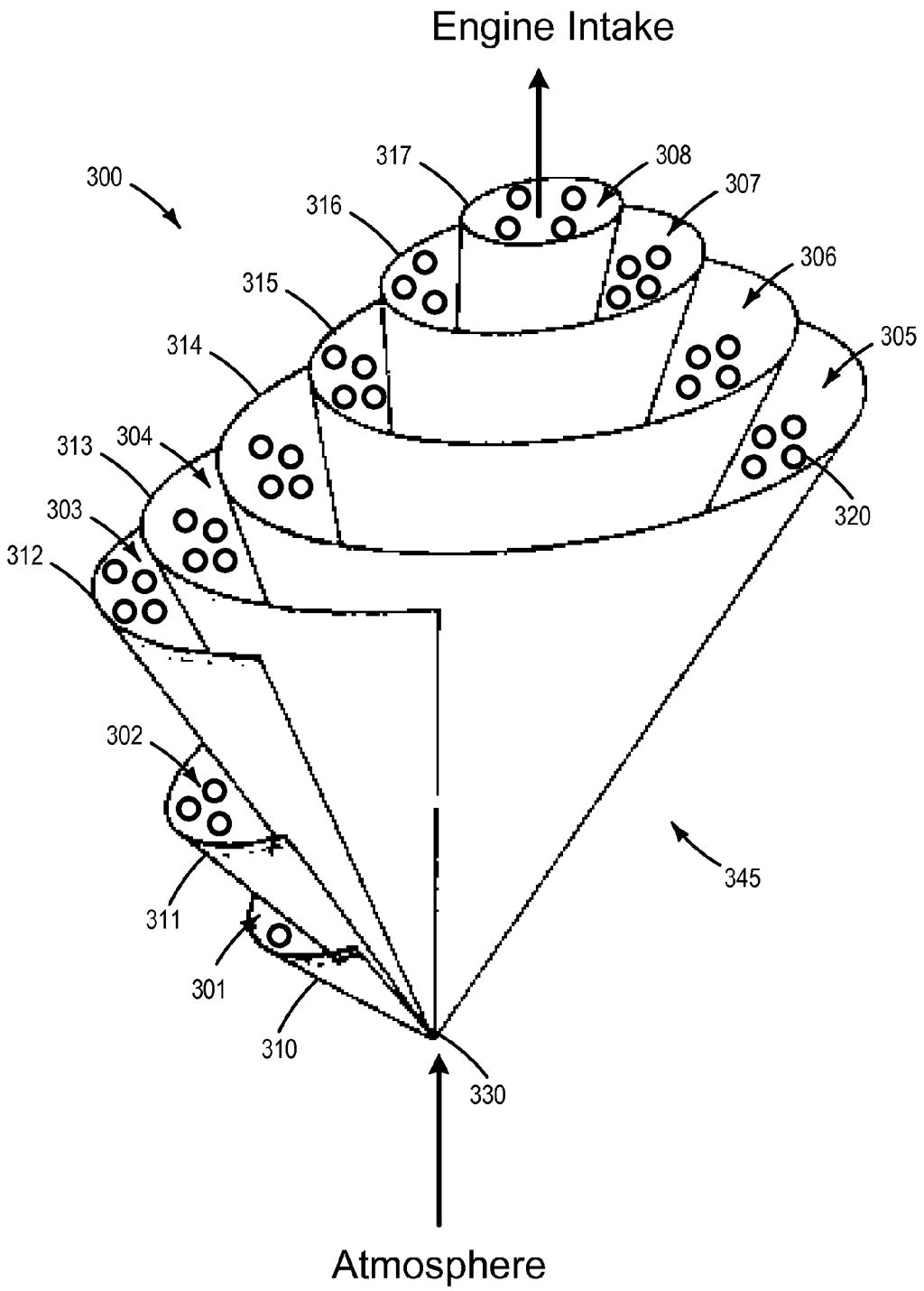
Figure 4:
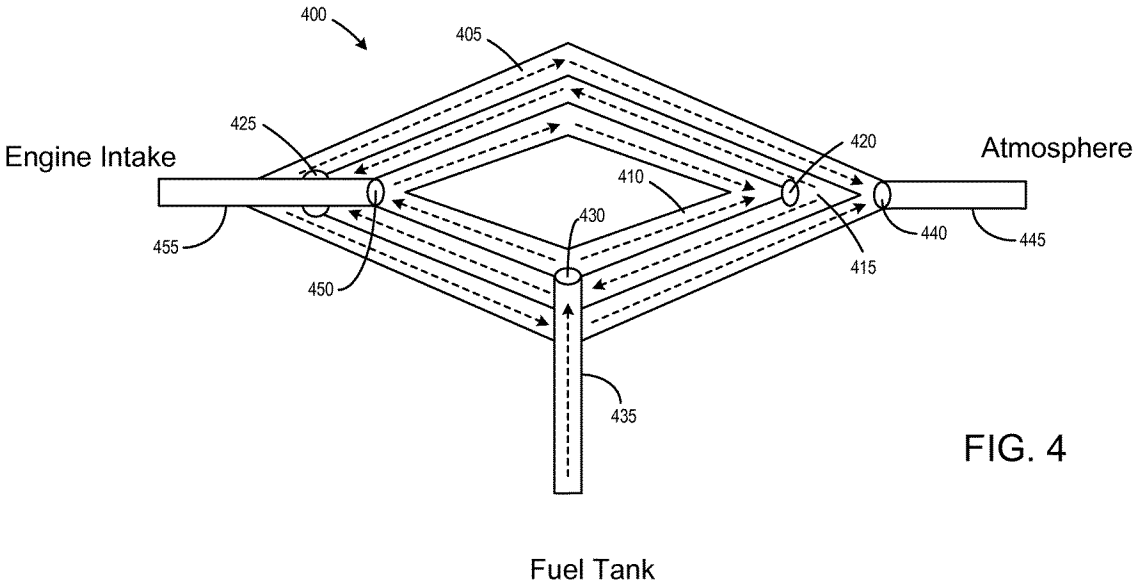
FIG. 4 shows fuel tank vapors being stored in a fuel vapor canister during fuel tank venting conditions.
Figure 5:
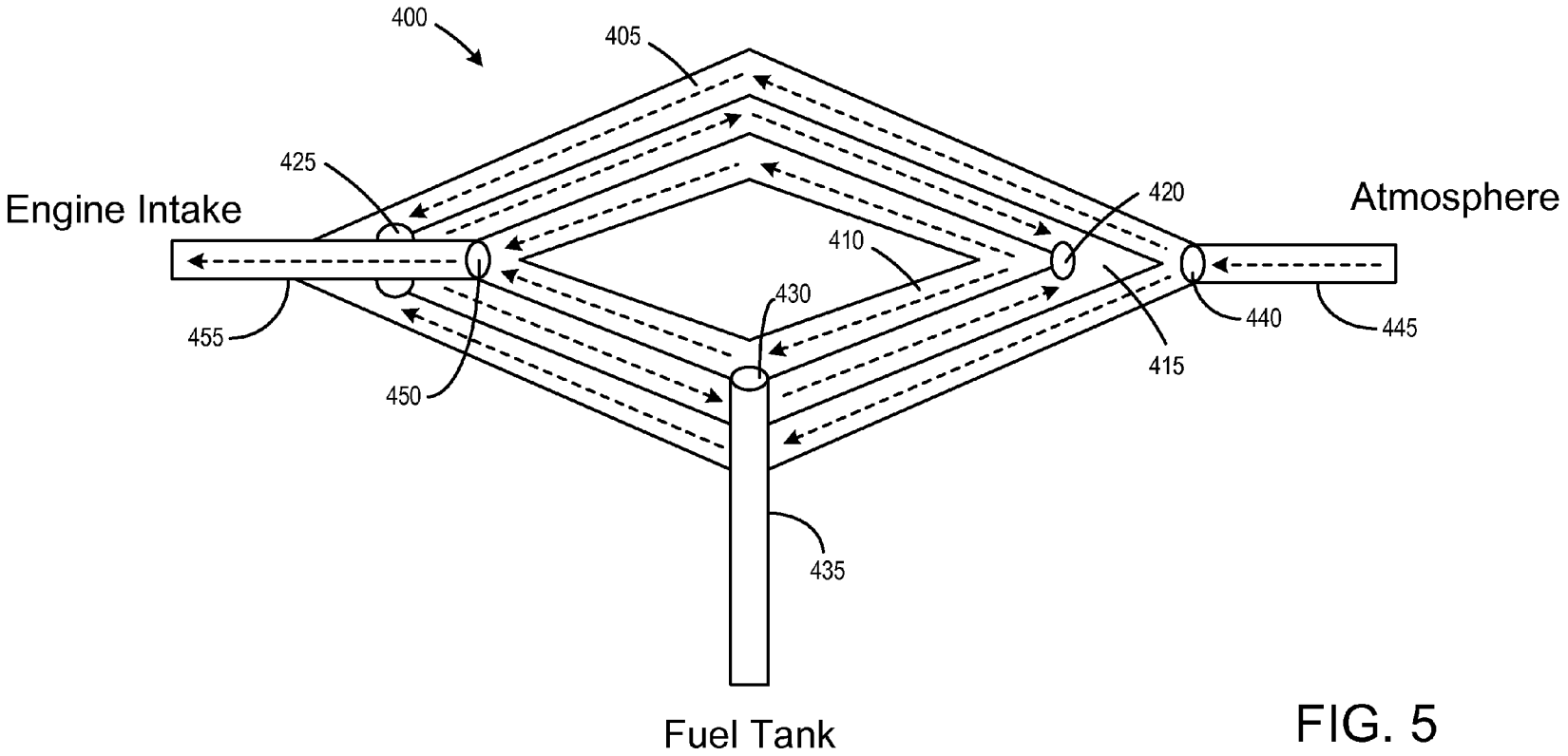
FIG. 5 shows hydrocarbons being purged from a fuel vapor canister during purging conditions.

This detailed description relates to systems and methods for a fuel vapor canister. In particular, the description relates to a fuel vapor canister with concentric, conical adsorbent beds. The fuel vapor canister may be a part of a fuel system for a vehicle, as shown in FIG. 1. FIG. 2 shows a bi-conical adsorbent bed that may be included in a fuel vapor canister. FIG. 3 shows concentric conical adsorbent beds that may be included in the fuel vapor canister. Adjacent adsorbent beds may be pneumatically coupled, as shown in FIGS. 4 and 5. FIG. 4 depicts the flow of fuel vapor through a fuel vapor canister during a fuel tank venting operation. FIG. 5 depicts the flow of fresh air through a fuel vapor canister during a canister purging operation.

FIG. 1 shows a schematic depiction of a hybrid vehicle system 6 that can derive propulsion power from engine system 8 and/or an on-board energy storage device, such as a battery system (not shown). An energy conversion device, such as a generator (not shown), may be operated to absorb energy from vehicle motion and/or engine operation, and then convert the absorbed energy to an energy form suitable for storage by the energy storage device.

Engine system 8 may include an engine 10 having a plurality of cylinders 30. Engine 10 includes an engine intake 23 and an engine exhaust 25. Engine intake 23 includes an air intake throttle 62 fluidly coupled to the engine intake manifold 44 via an intake passage 42. Air may enter intake passage 42 via air filter 52. Engine exhaust 25 includes an exhaust manifold 48 leading to an exhaust passage 35 that routes exhaust gas to the atmosphere. Engine exhaust 25 may include one or more emission control devices 70 mounted in a close-coupled position. The one or more emission control devices may include a three-way catalyst, lean NOx trap, diesel particulate filter, oxidation catalyst, etc. It will be appreciated that other components may be included in the engine such as a variety of valves and sensors, as further elaborated in herein. In some embodiments, wherein engine system 8 is a boosted engine system, the engine system may further include a boosting device, such as a turbocharger (not shown).

Engine system 8 is coupled to a fuel system 18. Fuel system 18 includes a fuel tank 20 coupled to a fuel pump 21 and a fuel vapor canister 22. During a fuel tank refueling event, fuel may be pumped into the vehicle from an external source through refueling port 108. Fuel tank 20 may hold a plurality of fuel blends, including fuel with a range of alcohol concentrations, such as various gasoline-ethanol blends, including E10, E85, gasoline, etc., and combinations thereof. A fuel level sensor 106 located in fuel tank 20 may provide an indication of the fuel level ("Fuel Level Input") to controller 12. As depicted, fuel level sensor 106 may comprise a float connected to a variable resistor. Alternatively, other types of fuel level sensors may be used.

Fuel pump 21 is configured to pressurize fuel delivered to the injectors of engine 10, such as example injector 66. While only a single injector 66 is shown, additional injectors are provided for each cylinder. It will be appreciated that fuel system 18 may be a return-less fuel system, a return fuel system, or various other types of fuel system. Vapors generated in fuel tank 20 may be routed to fuel vapor canister 22, via conduit 31, before being purged to the engine intake 23.

Fuel vapor canister 22 is filled with an appropriate adsorbent for temporarily trapping fuel vapors (including vaporized hydrocarbons) generated during fuel tank refueling operations, as well as diurnal vapors. In one example, the adsorbent used is activated charcoal. When purging conditions are met, such as when the canister is saturated, vapors stored in fuel vapor canister 22 may be purged to engine intake 23 by opening canister purge valve 112. While a single canister 22 is shown, it will be appreciated that fuel system 18 may include any number of canisters. In one example, canister purge valve 112 may be a solenoid valve wherein opening or closing of the valve is performed via actuation of a canister purge solenoid.

Canister 22 may include a buffer (or buffer region), each of the canister and the buffer comprising the adsorbent. The volume of the buffer may be smaller than (e.g., a fraction of) the volume of canister 22. The adsorbent in the buffer may be same as, or different from, the adsorbent in the canister (e.g., both may include charcoal). The buffer may be positioned within canister 22 such that during canister loading, fuel tank vapors are first adsorbed within the buffer, and then when the buffer is saturated, further fuel tank vapors are adsorbed in the canister. In comparison, during canister purging, fuel vapors are first desorbed from the canister (e.g., to a threshold amount) before being desorbed from the buffer. In other words, loading and unloading of the buffer is not linear with the loading and unloading of the canister. As such, the effect of the canister buffer is to dampen any fuel vapor spikes flowing from the fuel tank to the canister, thereby reducing the possibility of any fuel vapor spikes going to the engine.

Canister 22 includes a vent 27 for routing gases out of the canister 22 to the atmosphere when storing, or trapping, fuel vapors from fuel tank 20. Vent 27 may also allow fresh air to be drawn into fuel vapor canister 22 when purging stored fuel vapors to engine intake 23 via purge line 28 and purge valve 112. While this example shows vent 27 communicating with fresh, unheated air, various modifications may also be used. Vent 27 may include a canister vent valve 114 to adjust a flow of air and vapors between canister 22 and the atmosphere. The canister vent valve may also be used for diagnostic routines. When included, the vent valve may be opened during fuel vapor storing operations (for example, during fuel tank refueling and while the engine is not running) so that air, stripped of fuel vapor after having passed through the canister, can be pushed out to the atmosphere. Likewise, during purging operations (for example, during canister regeneration and while the engine is running), the vent valve may be opened to allow a flow of fresh air to strip the fuel vapors stored in the canister. In one example, canister vent valve 114 may be a solenoid valve wherein opening or closing of the valve is performed via actuation of a canister vent solenoid. In particular, the canister vent valve may be an open that is closed upon actuation of the canister vent solenoid. In some examples, an air filter may be coupled in vent 27 between canister vent valve 114 and atmosphere.

As such, hybrid vehicle system 6 may have reduced engine operation times due to the vehicle being powered by engine system 8 during some conditions, and by the energy storage device under other conditions. While the reduced engine operation times reduce overall carbon emissions from the vehicle, they may also lead to insufficient purging of fuel vapors from the vehicle's emission control system. To address this, a fuel tank isolation valve 110 may be optionally included in conduit 31 such that fuel tank 20 is coupled to canister 22 via the valve. During regular engine operation, isolation valve 110 may be kept closed to limit the amount of diurnal or "running loss" vapors directed to canister 22 from fuel tank 20. During refueling operations, and selected purging conditions, isolation valve 110 may be temporarily opened, e.g., for a duration, to direct fuel vapors from the fuel tank 20 to canister 22. By opening the valve during purging conditions when the fuel tank pressure is higher than a threshold (e.g., above a mechanical pressure limit of the fuel tank above which the fuel tank and other fuel system components may incur mechanical damage), the refueling vapors may be released into the canister and the fuel tank pressure may be maintained below pressure limits. While the depicted example shows isolation valve 110 positioned along conduit 31, in alternate embodiments, the isolation valve may be mounted on fuel tank 20. The fuel system may be considered to be sealed when isolation valve 110 is closed. In embodiments where the fuel system does not include isolation valve 110, the fuel system may be considered sealed when purge valve 112 and canister vent valve 114 are both closed.

One or more pressure sensors 120 may be coupled to fuel system 18 for providing an estimate of a fuel system pressure. In one example, the fuel system pressure is a fuel tank pressure, wherein pressure sensor 120 is a fuel tank pressure sensor coupled to fuel tank 20 for estimating a fuel tank pressure or vacuum level. While the depicted example shows pressure sensor 120 directly coupled to fuel tank 20, in alternate embodiments, the pressure sensor may be coupled between the fuel tank and canister 22, specifically between the fuel tank and isolation valve 110. In still other embodiments, a first pressure sensor may be positioned upstream of the isolation valve (between the isolation valve and the canister) while a second pressure sensor is positioned downstream of the isolation valve (between the isolation valve and the fuel tank), to provide an estimate of a pressure difference across the valve. In some examples, a vehicle control system may infer and indicate a fuel system leak based on changes in a fuel tank pressure during a leak diagnostic routine.

One or more temperature sensors 121 may also be coupled to fuel system 18 for providing an estimate of a fuel system temperature. In one example, the fuel system temperature is a fuel tank temperature, wherein temperature sensor 121 is a fuel tank temperature sensor coupled to fuel tank 20 for estimating a fuel tank temperature. While the depicted example shows temperature sensor 121 directly coupled to fuel tank 20, in alternate embodiments, the temperature sensor may be coupled between the fuel tank and canister 22.

Fuel vapors released from canister 22, for example during a purging operation, may be directed into engine intake manifold 44 via purge line 28. The flow of vapors along purge line 28 may be regulated by canister purge valve 112, coupled between the fuel vapor canister and the engine intake. The quantity and rate of vapors released by the canister purge valve may be determined by the duty cycle of an associated canister purge valve solenoid (not shown). As such, the duty cycle of the canister purge valve solenoid may be determined by the vehicle's powertrain control module (PCM), such as controller 12, responsive to engine operating conditions, including, for example, engine speed-load conditions, an air-fuel ratio, a canister load, etc. By commanding the canister purge valve to be closed, the controller may seal the fuel vapor recovery system from the engine intake.

An optional canister check valve (not shown) may be included in purge line 28 to prevent intake manifold pressure from flowing gases in the opposite direction of the purge flow. As such, the check valve may be necessary if the canister purge valve control is not accurately timed or the canister purge valve itself can be forced open by a high intake manifold pressure. An estimate of the manifold absolute pressure (MAP) or manifold vacuum (ManVac) may be obtained from MAP sensor 118 coupled to intake manifold 44, and communicated with controller 12. Alternatively, MAP may be inferred from alternate engine operating conditions, such as mass air flow (MAF), as measured by a MAF sensor (not shown) coupled to the intake manifold.

Fuel system 18 may be operated by controller 12 in a plurality of modes by selective adjustment of the various valves and solenoids. For example, the fuel system may be operated in a fuel vapor storage mode (e.g., during a fuel tank refueling operation and with the engine not running), wherein the controller 12 may open isolation valve 110 and canister vent valve 114 while closing canister purge valve (CPV) 112 to direct refueling vapors into canister 22 while preventing fuel vapors from being directed into the intake manifold.

As another example, the fuel system may be operated in a refueling mode (e.g., when fuel tank refueling is requested by a vehicle operator), wherein the controller 12 may open isolation valve 110 and canister vent valve 114, while maintaining canister purge valve 112 closed, to depressurize the fuel tank before allowing enabling fuel to be added therein. As such, isolation valve 110 may be kept open during the refueling operation to allow refueling vapors to be stored in the canister. After refueling is completed, the isolation valve may be closed.

As yet another example, the fuel system may be operated in a canister purging mode (e.g., after an emission control device light-off temperature has been attained and with the engine running), wherein the controller 12 may open canister purge valve 112 and canister vent valve while closing isolation valve 110. Herein, the vacuum generated by the intake manifold of the operating engine may be used to draw fresh air through vent 27 and through fuel vapor canister 22 to purge the stored fuel vapors into intake manifold 44. In this mode, the purged fuel vapors from the canister are combusted in the engine. The purging may be continued until the stored fuel vapor amount in the canister is below a threshold. During purging, the learned vapor amount/concentration can be used to determine the amount of fuel vapors stored in the canister, and then during a later portion of the purging operation (when the canister is sufficiently purged or empty), the learned vapor amount/concentration can be used to estimate a loading state of the fuel vapor canister.

Vehicle system 6 may further include control system 14. Control system 14 is shown receiving information from a plurality of sensors 16 (various examples of which are described herein) and sending control signals to a plurality of actuators 81 (various examples of which are described herein). As one example, sensors 16 may include exhaust gas sensor 126 located upstream of the emission control device, temperature sensor 128, MAP sensor 118, pressure sensor 120, and pressure sensor 129. Other sensors such as additional pressure, temperature, air/fuel ratio, and composition sensors may be coupled to various locations in the vehicle system 6. For example, ambient temperature and pressure sensors may be coupled to the exterior of the vehicle body. As another example, the actuators may include fuel injector 66, isolation valve 110, purge valve 112, vent valve 114, fuel pump 21, and throttle 62.

Control system 14 may further receive information regarding the location of the vehicle from an on-board global positioning system (GPS). Information received from the GPS may include vehicle speed, vehicle altitude, vehicle position, etc. This information may be used to infer engine operating parameters, such as local barometric pressure. Control system 14 may further be configured to receive information via the internet or other communication networks. Information received from the GPS may be cross-referenced to information available via the internet to determine local weather conditions, local vehicle regulations, etc. Control system 14 may use the internet to obtain updated software modules which may be stored in non-transitory memory.

The control system 14 may include a controller 12. Controller 12 may be configured as a conventional microcomputer including a microprocessor unit, input/output ports, read-only memory, random access memory, keep alive memory, a controller area network (CAN) bus, etc. Controller 12 may be configured as a powertrain control module (PCM). The controller may be shifted between sleep and wake-up modes for additional energy efficiency. The controller may receive input data from the various sensors, process the input data, and trigger the actuators in response to the processed input data based on instruction or code programmed therein corresponding to one or more routines.

Controller 12 may also be configured to intermittently perform leak detection routines on fuel system 18 (e.g., fuel vapor recovery system) to confirm that the fuel system is not degraded. As such, various diagnostic leak detection tests may be performed while the engine is off (engine-off leak test) or while the engine is running (engine-on leak test). Leak tests performed while the engine is running may include applying a negative pressure on the fuel system for a duration (e.g., until a target fuel tank vacuum is reached) and then sealing the fuel system while monitoring a change in fuel tank pressure (e.g., a rate of change in the vacuum level, or a final pressure value). Leak tests performed while the engine is not running may include sealing the fuel system following engine shut-off and monitoring a change in fuel tank pressure. This type of leak test is referred to herein as an engine-off natural vacuum test (EONV). In sealing the fuel system following engine shut-off, a vacuum will develop in the fuel tank as the tank cools and fuel vapors are condensed to liquid fuel. The amount of vacuum and/or the rate of vacuum development may be compared to expected values that would occur for a system with no leaks, and/or for a system with leaks of a predetermined size. Following a vehicle-off event, as heat continues to be rejected from the engine into the fuel tank, the fuel tank pressure will initially rise. During conditions of relatively high ambient temperature, a pressure build above a threshold may be considered a passing test.

Typically, fuel vapor canisters have a cylindrical or rectangular shape. Because of this, air flow through such canisters is not uniform. Some canister regions will experience a greater air flow than others. Thus, while purging the canister, the regions of adsorbent within the canister that experience less purge air flow may not be cleaned off hydrocarbons. These regions are known as the canister heel. The size of the heel may encompass 10-15% of the canister volume, and may increase as the canister ages, thus limiting the capacity of the canister to adsorb fuel vapor.

FIG. 2 schematically shows a cross-section of a fuel vapor canister 200 comprising a conical flow path. As depicted, fuel vapor canister 200 comprises a single adsorbent bed 205, but as shown in FIGS. 3-5, the fuel vapor canister may comprise multiple adsorbent beds. Adsorbent bed 205 is defined by exterior wall 210 and interior wall 215. Exterior wall 210 and interior wall 215 may be molded from a thermostable material, for example a thermoplastic polymer, such as nylon. Adsorbent bed 205 may comprise a plurality of adsorbent granules 220. Adsorbent granules 220 may be manufactured from a suitable adsorbent, such as activated charcoal or carbon, capable of binding and releasing fuel vapor. The granules may be tightly packed together within the adsorbent bed in a fashion that allows air and fuel vapor to pass through the adsorbent bed, while maintaining the granules in contact with both exterior wall 210 and interior wall 215. In this way, fuel vapor may enter the adsorbent bed and bind to the active carbon, while gasses stripped of fuel vapor are discharged. Similarly, fresh air may be drawn through the adsorbent bed, desorbing the bound hydrocarbons. Structural elements may be placed between exterior wall 210 and interior wall 215 to maintain the structure of the adsorbent bed.

Fuel vapor canister 200 may comprise one or more vent ports 230, one or more purge ports 235 and one or more load ports 240. Vent port 230 couples fuel vapor canister 200 to atmosphere via a vent line. Purge port 235 couples fuel vapor canister 200 to engine intake via a purge line. Load port 240 couples fuel vapor canister 200 to a fuel tank via a load conduit.

As depicted in FIG. 2, adsorbent bed 205 is a bi-conical bed. The bed may be divided into two right-circular cones, an atmospheric-side cone 245 and an intake-side cone 250. However, atmospheric-side cone 245 and intake-side cone 250 are pneumatically coupled together and may be contiguously formed. In some examples, exterior wall 210 and interior wall 215 may be concave or convex to improve flow of gasses through adsorbent bed 205. Further, the portions of the adsorbent bed at the intersection of atmospheric-side cone 245 and intake-side cone 250 may be rounded or otherwise structured to reduce turbulence, improve airflow, or otherwise ensure even distribution of air throughout adsorbent bed 205 during a purge event. The cone opening angle is shown here as ~45°, but may be a larger or smaller angle.

During a purge event, a vacuum applied to purge port 235, such as an engine intake vacuum will draw fresh air through vent port 230. Fresh air may enter adsorbent bed 205 at atmospheric-side cone 245, desorbing hydrocarbons bound to adsorbent granules 220. Gasses comprising fresh air and desorbed hydrocarbons will then enter intake-side cone 250 of adsorbent bed 205. Additional hydrocarbons may be desorbed from adsorbent granules 220. The desorbed hydrocarbons may then exit fuel vapor canister 200 at purge port 235. The bi-conical configuration of fuel vapor canister 200 may increase the efficiency of purging by allowing purge air to come in contact with each region of adsorbent bed 205 equally, thereby reducing the canister heel.

FIG. 3 shows a cutaway view of a fuel vapor canister 300 comprising a plurality of concentric conical adsorbent beds. Fuel vapor canister 300 includes an outermost concentric adsorbent bed 301, intermediate concentric adsorbent beds 302, 303, 304, 305, 306, and 307, and an innermost concentric adsorbent bed 308. Fuel vapor canister 300 includes exterior wall 310, as well as partition walls 311, 312, 313, 314, 315, 316, and 317. The partition walls act as an interior wall for a first adsorbent bed, and act as an exterior wall for an adjacent adsorbent bed. For example, partition wall 311 acts as an interior wall for outermost adsorbent bed 301, and acts as an exterior wall for intermediate concentric adsorbent bed 302, partition wall 312 acts as an interior wall for intermediate concentric adsorbent bed 302, and acts as an exterior wall for intermediate concentric adsorbent bed 303, etc. Each adsorbent bed comprises a plurality of adsorbent granules 320 that are tightly packed together within the adsorbent bed.

Fuel vapor canister 300 includes a vent port 330 located at an apex of atmospheric-side cone 345. Fuel vapor canister 300 may also include a load port and purge port (not shown). The purge port may be located at an apex of an intake-side cone (not shown). Vent port 330 may be configured to couple outermost concentric adsorbent bed 301 to atmosphere, and thus to deliver fresh air to the outermost concentric adsorbent bed. In some examples, vent port 330 may couple two or more adsorbent beds directly to atmosphere. In this way, fresh air may be delivered to each adsorbent bed coupled to vent port.

In other examples, only outermost adsorbent bed 301 is coupled to vent port 330, while each adsorbent bed is pneumatically coupled to an adjacent adsorbent bed. For example, outermost adsorbent bed 301 may be coupled to adsorbent bed 302. Adsorbent bed 302 may be further coupled to adsorbent bed 303, etc. An example of this configuration is described herein and with regard to FIGS. 4 and 5.

In some examples, the purge port may couple two or more adsorbent beds directly to the engine intake. In other examples, only innermost adsorbent bed 308 is coupled to the purge port, while each adsorbent bed is pneumatically coupled to an adjacent adsorbent bed. In this configuration, fresh air directed into the vent port sequentially passes through adjacent adsorbent beds, desorbing hydrocarbons. The desorbed hydrocarbons exit innermost adsorbent bed 308 via the purge port.

It will be appreciated that the fuel vapor canisters depicted in FIGS. 2-5 are provided as examples, and are not meant to be limiting. As such, the fuel vapor canister may include additional or alternative components than those depicted. For example, the fuel vapor canister may include one or more filters to maintain carbon dust within the canister during vehicle operation. The fuel vapor canister may include an external cover that encloses the adsorbent beds and partitions. The external cover may accommodate one or more load ports, purge ports, and vent ports. Further, it will be appreciated that the one or more ports may be located at other positions than those depicted without departing from the scope of this disclosure. The fuel vapor canister and/or the external cover may include various tabs for J-clips, self-tap screw bosses, pins, etc. for attaching the fuel vapor canister to a vehicle.

The fuel vapor canister may comprise one or more temperature sensors configured to determine the temperature of one or more adsorbent beds. The adsorption of hydrocarbon is an exothermic reaction. As such, fuel vapor canister loading is accompanied by a temperature increase. Conversely, the desorption of hydrocarbon is an endothermic reaction. As such, fuel vapor canister purging is accompanied by a temperature decrease. By measuring changes in fuel vapor canister temperature during loading and purging, a canister load may be determined. By placing multiple temperature sensors within the canister, the load within specific regions or adsorption beds may be determined based on local temperature changes.

The fuel vapor canister may be coupled to one or more heating elements, such as an electric heating element. The heating element may function to warm the adsorbent and/or the purge air prior to and/or during a purge event. By heating the adsorbent and/or the purge air, the efficiency of desorption may be increased.

One or more oxygen and/or hydrocarbon sensors may be coupled near the fuel vapor canister ports. In this way, gasses entering or exiting the fuel vapor canister may be monitored for oxygen and/or hydrocarbon content. This may inform canister load calculations and/or purge concentration calculations, and may further determine hydrocarbon breakthrough from the canister.

FIG. 4 schematically shows fuel tank vapors being stored in a fuel vapor canister during fuel tank venting conditions. Fuel vapor canister 400 comprises three conical adsorbent beds—outermost bed 405, innermost bed 410, and center bed 415. However, in other embodiments any number of adsorbent beds may be concentrically coupled together within canister 400. Innermost bed 410 and center bed 415 are pneumatically coupled via conduit 420. Outermost bed 405 and center bed 415 are pneumatically coupled via conduit 425. Conduits 420 and 425 may comprise one or more openings in the partitions between the respective beds, configured to allow the flow of gasses between adjacent beds.

Load port 430 couples innermost bed 410 to a fuel tank via conduit 435. As described with regard to FIG. 1, a fuel tank may be coupled to the canister via a fuel tank isolation valve. Vent port 440 couples outermost bed 405 to atmosphere via vent line 445. A canister vent valve may be coupled within the vent line. Purge port 450 couples innermost bed 410 to engine intake via purge line 455. A canister purge valve may be coupled within the purge line. By coupling load port 430 to innermost bed 410, the innermost bed may act as a buffer. For example, is the fuel tank is vented during a purge event, fuel vapor entering the canister will not enter the engine directly. This improves emissions system performance, as venting vapor directly to the engine may cause engine stalling.

The dashed arrows in FIG. 4 depict the movement of fuel vapor within fuel vapor canister 400 during a fuel tank venting condition. The fuel tank may be vented during engine operation, prior to refueling (depressurization), and/or during refueling. During fuel tank venting, purge line 455 may be closed via a purge valve, while vent line 445 may be open via a vent valve, coupling the canister to atmosphere, thus establishing a flow path between the fuel tank and atmosphere. Fuel vapor from the fuel tank travels through conduit 435 and enters innermost bed 410 via load port 430. Once fuel vapor enters innermost bed 410, it may diffuse towards purge port 450 as well as conduit 420. However, while the purge line is closed and the vent line is open, the bulk flow of fuel vapor will be towards conduit 420. Some hydrocarbons will be adsorbed by adsorbent granules within innermost bed 410. The remaining fuel vapor will pass through conduit 420 and enter center bed 415 at a lower concentration than the fuel vapor entering innermost bed 410, unless the adsorbent in the innermost bed is saturated. Once fuel vapor enters center bed 415, it may diffuse towards conduit 425. Some hydrocarbons will be adsorbed by adsorbent granules within center bed 415. The remaining fuel vapor will pass through conduit 425 and enter outermost bed 405 at a lower concentration than the fuel vapor entering center bed 415, unless the adsorbent in the center bed is saturated. Once fuel vapor enters outermost bed 405, it may diffuse towards vent port 440. Some hydrocarbons will be adsorbed by adsorbent granules within outermost bed 405. The remaining gasses stripped of fuel vapor will pass through vent port 440, into vent line 445, and eventually diffuse into the atmosphere. In this configuration, the flow direction of fuel vapor and gasses stripped of fuel vapor is reversed as the gasses pass between adjacent adsorbent beds.

FIG. 5 schematically shows hydrocarbons being purged from fuel vapor canister 400 during purging conditions. During fuel vapor canister purging, purge line 455 may be open via a purge valve, coupling the canister to an engine intake. Vent line 445 may be open via a vent valve, coupling the canister to atmosphere, thus establishing a flow path between atmosphere and engine intake. Purging conditions may include an intake vacuum of a threshold amount, establishing a flow gradient towards engine intake. Fresh air drawn through the canister may desorb hydrocarbons and carry them to engine intake, where they may be used in combustion.

Fresh air enters travels through vent line 445, entering outermost bed 405 via vent port 440. Once fresh air enters outermost bed 405, it may be drawn towards conduit 425, desorbing hydrocarbons bound to adsorbent. Gasses comprising fresh air and desorbed hydrocarbons may then enter center bed 415 via conduit 425. Once the gasses enter center bed 415, they may be drawn towards conduit 420. Some hydrocarbons will be desorbed by adsorbent granules within center bed 415. Gasses may then enter innermost bed 410 via conduit 420 with a higher concentration of desorbed hydrocarbon than the gasses entering center bed 415. Once the gasses enter innermost bed 410, they may be drawn towards purge port 450. Some hydrocarbons will be desorbed by adsorbent granules within innermost bed 410. Gasses comprising fresh air and desorbed hydrocarbons may then enter purge line 455, and be drawn towards engine intake. In this configuration, the flow direction of fresh air and desorbed hydrocarbons is reversed as the gasses pass between adjacent adsorbent beds.

The systems described herein and depicted in FIGS. 1-5 may enable one or more systems and one or more methods. In one example, a fuel vapor canister is enabled, comprising two or more pneumatically coupled concentric adsorbent beds, a vent port configured to deliver fresh air to an outermost concentric adsorbent bed, and a purge port configured to couple an engine intake to an innermost concentric adsorbent bed. The fuel vapor canister may further comprise a load port configured to couple a fuel tank to the innermost concentric adsorbent bed. The concentric adsorbent beds may have a bi-conical structure. The vent port may be located at an apex of an atmospheric-side cone. The purge port may be located at an apex of an intake-side cone. Adjacent adsorbent beds may be pneumatically coupled via one or more conduits. A flow direction may be reversed between adjacent adsorbent beds. The technical result of implementing this fuel vapor canister is a decrease in bleed emissions. The concentric adsorbent beds facilitate uniform loading and improved purging of the canister, thus decreasing residual hydrocarbons within the canister following a purge event.

In another example, a fuel system is enabled, comprising an engine intake and a fuel vapor canister, comprising two or more pneumatically coupled concentric adsorbent beds; a vent port configured to deliver fresh air to an outermost concentric adsorbent bed; and a purge port configured to couple an engine intake to an innermost concentric adsorbent bed. The fuel system may further comprise a fuel tank; and a load port configured to couple the fuel tank to the innermost concentric adsorbent bed. The concentric adsorbent beds may have a bi-conical structure. A flow direction may be reversed between adjacent adsorbent beds. The fuel system may further comprise a vent line coupling the vent port to atmosphere via a vent valve; wherein the vent port may be located at an apex of an atmospheric-side cone. The fuel system may further comprise a purge line coupling the purge port to the engine intake via a purge valve; wherein the purge port may be located at an apex of an intake-side cone. The fuel system may further comprise a conduit coupling the fuel tank to the load port via a fuel tank isolation valve. The technical result of implementing this system is a reduction in engine stalls during purging. By loading the innermost concentric adsorbent bed, the innermost bed acts as a buffer for the canister. Thus, if the fuel tank is vented during purge events, the fuel vapor will not enter the engine intake directly.

In yet another example, a method for a fuel system is enabled, comprising during a first condition, directing fresh air to an outermost concentric adsorbent bed of a fuel vapor canister comprising two or more concentric adsorbent beds; and directing desorbed hydrocarbons from an innermost concentric adsorbent bed to an engine intake. The first condition may include a fuel vapor canister load above a threshold. Directing fresh air to an outermost concentric adsorbent bed may comprise opening a vent valve coupled between the outermost concentric adsorbent bed and atmosphere, and directing desorbed hydrocarbons from an innermost concentric adsorbent bed to the engine intake may comprise opening a purge valve coupled between the innermost concentric adsorbent bed and the engine intake. The method may further comprise: during a second condition, directing fuel vapor from a fuel tank to the innermost concentric adsorbent bed; and directing gasses stripped of fuel vapor from the outermost concentric adsorbent bed to atmosphere. The second condition may include a refueling event. Directing fuel vapor from the fuel tank to the innermost concentric adsorbent bed may comprise opening a fuel tank isolation valve coupled between the fuel tank and the innermost concentric adsorbent bed, and directing gasses stripped of fuel vapor from the outermost concentric adsorbent bed to atmosphere may comprise opening a vent valve coupled between the outermost concentric adsorbent bed and atmosphere. The technical result of implementing this method is an increased practical canister capacity. The bi-conical structure yields a conical flow path allows fresh air to flow through the adsorbent beds equally, thus reducing the size of a canister heel.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A fuel vapor canister, comprising:

two or more pneumatically coupled concentric adsorbent beds;

a vent port configured to deliver fresh air to an outermost concentric adsorbent bed; and a purge port configured to couple an engine intake to an innermost concentric adsorbent bed;

wherein the concentric adsorbent beds have a bi-conical structure comprising two conical shapes adjoined at their respective bases.

2. The fuel vapor canister of claim 1, further comprising:

a load port configured to couple a fuel tank to the innermost concentric adsorbent bed.

3. The fuel vapor canister of claim 1, wherein the vent port is located at an apex of an atmospheric-side cone.

4. The fuel vapor canister of claim 1, wherein the purge port is located at an apex of an intake-side cone, and wherein granules of adsorbent material are packed within the beds that have the bi-conical structure.

5. The fuel vapor canister of claim 4, wherein adjacent adsorbent beds are pneumatically coupled via one or more conduits, and wherein the beds are nested inside one another.

6. The fuel vapor canister of claim 5, wherein a flow direction is reversed between adjacent adsorbent beds, and further comprising three or more nested beds.

7. The fuel vapor canister of claim 6, wherein each bed pneumatically communicates with adjacent beds via conduits, and wherein the conduits are located on alternating apexes.

8. A fuel system, comprising:

an engine intake; and a fuel vapor canister, comprising:

two or more pneumatically coupled concentric adsorbent beds;

a vent port configured to deliver fresh air to an outermost concentric adsorbent bed; and a purge port configured to couple the engine intake to an innermost concentric adsorbent bed, wherein the concentric adsorbent beds have a bi-conical structure comprising two conical shapes adjoined at their respective bases.

9. The fuel system of claim 8, further comprising:

a fuel tank; and a load port configured to couple the fuel tank to the innermost concentric adsorbent bed.

10. The fuel system of claim 8, wherein a flow direction is reversed between adjacent adsorbent beds, and further comprising at least three concentric adsorbent beds.

11. The fuel system of claim 9, further comprising:

a vent line coupling the vent port to atmosphere via a vent valve; and wherein the vent port is located at an apex of an atmospheric-side cone.

12. The fuel system of claim 11, further comprising:

a purge line coupling the purge port to the engine intake via a purge valve; and wherein the purge port is located at an apex of an intake-side cone, wherein the intake-side cone is located opposite the atmospheric-side cone.

13. The fuel system of claim 9, further comprising:

a conduit coupling the fuel tank to the load port via a fuel tank isolation valve, and at least one conduit connecting adjacent concentric adsorbent beds, the at least one conduit being located at one or more apexes of the adsorbent beds.

14. A method for a fuel system, comprising:

during a first condition, directing fresh air to an outermost concentric adsorbent bed of a fuel vapor canister comprising two or more concentric adsorbent beds; and directing desorbed hydrocarbons from an innermost concentric adsorbent bed to an engine intake;

wherein the concentric adsorbent beds have a bi-conical structure comprising two conical shapes adjoined at their respective bases.

15. The method of claim 14, wherein the first condition includes a fuel vapor canister load above a threshold, wherein the fuel vapor canister includes at least three concentric adsorbent beds, where each bed communicates with an adjacent bed through only one conduit each, and where a direction of gas flow is reversed between adjacent beds.

16. The method of claim 14, wherein directing fresh air to the outermost concentric adsorbent bed comprises opening a vent valve coupled between the outermost concentric adsorbent bed and atmosphere, and wherein directing desorbed hydrocarbons from the innermost concentric adsorbent bed to the engine intake comprises opening a purge valve coupled between the innermost concentric adsorbent bed and the engine intake, and wherein the concentric adsorbent beds comprise granules of adsorbent material packed within the beds having the bi-conical structure, where the beds having the bi-conical structure are nested inside one another.

17. The method of claim 14, further comprising:

during a second condition, directing fuel vapor from a fuel tank to the innermost concentric adsorbent bed; and directing gasses stripped of fuel vapor from the outermost concentric adsorbent bed to atmosphere;

wherein the fresh air is directed to an apex on an atmospheric side of the fuel vapor canister.

18. The method of claim 17, where the second condition includes a refueling event, and wherein the desorbed hydrocarbons are directed from an apex on an intake side of the fuel vapor canister, the intake side opposite the atmospheric side.

19. The method of claim 17, wherein directing fuel vapor from the fuel tank to the innermost concentric adsorbent bed comprises opening a fuel tank isolation valve coupled between the fuel tank and the innermost concentric adsorbent bed, and wherein directing gasses stripped of fuel vapor from the outermost concentric adsorbent bed to atmosphere comprises opening a vent valve coupled between the outermost concentric adsorbent bed and atmosphere.

* * * * *